United States Patent [19]

Sluyterman

[11] Patent Number: 4,823,046

[45] Date of Patent: Apr. 18, 1989

[54] COLOR PICTURE TUBE WITH ASTIGMATISM CORRECTION MEANS

[75] Inventor: Albertus A. S. Sluyterman, Eindhoven, Netherlands

[73] Assignee: U.S. Philips Corp., New York, N.Y.

[21] Appl. No.: 69,687

[22] Filed: Jul. 6, 1987

[30] Foreign Application Priority Data

Jul. 10, 1986 [NL] Netherlands ..... 8601803

[51] Int. Cl.[4] ..... H01J 29/70

[52] U.S. Cl. ..... 313/431; 313/437; 313/440; 335/210

[58] Field of Search ..... 313/431, 433, 437, 440, 313/436, 413; 335/210

[56] References Cited

U.S. PATENT DOCUMENTS

| | | | |
|---|---|---|---|
| 4,143,345 | 3/1979 | Barkow | 335/210 X |
| 4,231,009 | 10/1980 | Barkow | 335/210 X |
| 4,242,612 | 12/1980 | Heijnemans et al. | 335/210 X |
| 4,307,363 | 12/1981 | McGlashen | 335/210 X |
| 4,415,831 | 11/1983 | Konosv | 313/431 X |
| 4,524,340 | 6/1985 | Sluyterman | 335/210 X |
| 4,618,843 | 10/1986 | Nakamura | 335/210 |

FOREIGN PATENT DOCUMENTS 200442 10/1985 Japan ..... 313/440

*Primary Examiner*—David K. Moore
*Assistant Examiner*—Michael Horabik
*Attorney, Agent, or Firm*—Thomas A. Briody; Algy Tamoshunas; Leroy Eason

[57] ABSTRACT

An in-line color picture tube including a deflection unit having a system of deflection coils accommodating two sets of soft magnetic correction elements. The first set is provided in the proximity of the center of the vertical deflection field and symmetrically with respect to the plane through the non-deflected electron beams. The second set is also provided in the proximity of the center of the vertical deflection field, but closer to the entrance side thereof and symmetrically with respect to the plane through the tube axis which is at right angles to the plane through the non-deflected electron beams. The second set of correction elements is thereby angularly rotated 90° relative to the first set of correction elements. The first set provides conventional astigmatism correction, and the second set provides astigmatism correction of higher order components of the deflection field.

2 Claims, 1 Drawing Sheet

COLOR PICTURE TUBE WITH ASTIGMATISM CORRECTION MEANS

BACKGROUND OF THE INVENTION

1. Field of the Invention

The invention relates to a colour picture tube whose neck accommodates an electron gun system for emitting to a display screen, three co-planar electron beams, viz. a central beam which coincides at least substantially with the axis of the picture tube and two outer beams located on either side thereof, and including a deflection unit which is secured coaxially around the picture tube, which deflection unit comprises a system of line deflection coils which, when energized, deflects the electron beam in a first direction and a system of field deflection coils which, when energized, deflects the electron beam in a direction normal to the first direction, whilst elements of a soft magnetic material positioned symmetrically with respect to the plane through the non-deflected electron beams are provided between the systems of line and field deflection coils in the proximity of the centre of the deflection field generated by the system of field deflection coils.

2. Description of the Related Art

In colour picture tubes of the in-line type the electron gun system is adapted to generate three co-planar electron beams which converge on the display screen. The deflection unit placed around the picture tube for deflecting the electron beams is used to deflect the electron beams in one or in the other direction of their normal non-deflected straight path so that the beams impinge upon selected dots of the display screen to provide visual indications thereon. By varying the magnetic deflection fields in a suitable manner, the electron beams can be moved upwards or downwards and to the left or to the right across the (vertically placed) display screen. By simultaneously varying the intensity of the beams, a visual presentation of information or an image can be formed on the display screen. The deflection unit secured around the neck portion of the picture tube comprises two systems of deflection coils to enable the electron beams to be deflected in two directions at right angles with respect to each other. Each system comprises two coils placed on sides facing each other of the neck of the tube, the systems being displaced with respect to each other around the neck of the tube over an angle of 90°. Upon energizing, the two systems of deflection coils produce orthogonal deflection fields.

The fields are essentially at right angles to the path of the non-deflected electron beams. A cylindrical core of a magnetizable material, which encloses the system of line deflection coils, if this system is of the saddle type, is generally used to concentrate the deflection fields and to increase the flux density in the deflection region.

Line deflection coils of the saddle type are coils comprising a plurality of conductors which are wound to form longitudinal first and second side packets, an arc-shaped first end segment and an arc-shaped second end segment together defining a window aperture. In such coils the rear end segments (on the side of the gun) may be flared with respect to the profile of the picture tube (the original type of saddle coil) or they may be arranged flat against the tube wall (in this type of saddle coil the rear end segment follows, as it were, the tube profile). In a hybrid deflection unit the field deflection coils are of the type which is toroidally wound on the annular core.

After mounting a deflection unit provided with field deflection coils and line deflection coils on the picture tube for which it is intended, residual errors are often found to occur during operation.

The technical possibilities of winding deflection coils are not adequate to make coils with such a winding distribution that all requirements relating to convergence and raster are simultaneously satisfied. In a known deflection unit a number of soft magnetic elements are provided which influence the magnetic field of the system of coils providing vertical deflection and thereby reduce residual convergence errors in the corners of the display screen. In contrast thereto, geometrical (raster) errors are corrected, if necessary, by using permanent magnets which are mounted on the outside of the coils against the side of the coil holder which is to face the display screen.

Number, shape and size of the conversions correction elements, as well as their position with respect to the system of coils for vertical deflection must meet stringent requirements in any type of deflection unit. For units of the same type these requirements are, however, equal. The soft magnetic elements therefore do not serve to eliminate individual differences in the properties of the units of one type, but they are to correct residual errors relating to convergence in the design of a deflection unit type.

Astigmatism correction and coma correction elements have been known so far as correction elements (or in other words: field shapers). The astigmatism correction element is provided in the proximity of the centre of the deflection field generated by the system of field deflection coils and comprises soft magnetic elements which are positioned symmetrically with respect to the plane through the non-deflected electron beams. It is used both in combination with field deflection coils of the saddle type and of the toroidal type wound on the annular core. The coma correction element is only used in combination with field deflection coils of the saddle type. The coma correction element comprises soft magnetic elements which are positioned symmetrically with respect to the plane through the tube axis which is at right angles to the plane through the non-deflected electron beams, and is provided at the entrance side of the deflection field generated by the system of field deflection coils where there has been hardly any or no pre-deflection. In colour picture tubes which comprise a deflection unit with a system of field deflection coils of the toroidally wound type coma correction is generally effected within the tube. To this end the coma correction elements are provided on the electron gun system, for example, one element for each of the two outer beams.

Despite the use of astigmatism correction elements in the system of field deflection coils, astigmatism errors of higher order components of the deflection field are still found to occur in the present-day colour picture tubes.

SUMMARY OF THE INVENTION

It is an object of the invention to provide a colour picture tube with an improved correction of higher order (particularly 5th order) components of the deflecting field produced by the deflection unit.

According to the invention, in a colour picture tube of the type described in the opening paragraph this object is realized in that further elements of a soft magnetic material, which are positioned symmetrically with respect to the plane through the tube axis at right angles to the plane through the non-deflected electron beams, are also provided in the proximity of the centre of the deflection field generated by the system of field deflection coils, but closer to the entrance side thereof.

The invention thus provides for a correction element which is added to the astigmatism correction element and is rotated 90° with respect to the (conventional) astigmatism correction element and is provided in a position where pre-deflection has already taken place. Consequently it has a positive action on the astigmatism error. In the case of suitable adaptation of the astigmatism correction element, correction of higher (particularly 5th) order components of the deflecting field the deflection unit is found to improve clearly.

If the correction element added to the astigmatism correction element is in a position where there is field pre-deflection but no line pre-deflection, the added correction element provides a means to control the so-called 3rd order trilemma problem (which is more difficult to solve as the display screen is flatter and its corners are more rectangular). For this use the vertical deflection field should start before the horizontal deflection field (in other words, the vertical deflection field must extend further to the electron gun system than the horizontal deflection field).

The invention also relates to a deflection unit for a colour picture tube as described above.

BRIEF DESCRIPTION OF THE DRAWINGS

The invention will be described in greater detail with reference to the drawing in which.

DESCRIPTION OF THE PREFERRED EMBODIMENTS

Figure 1:
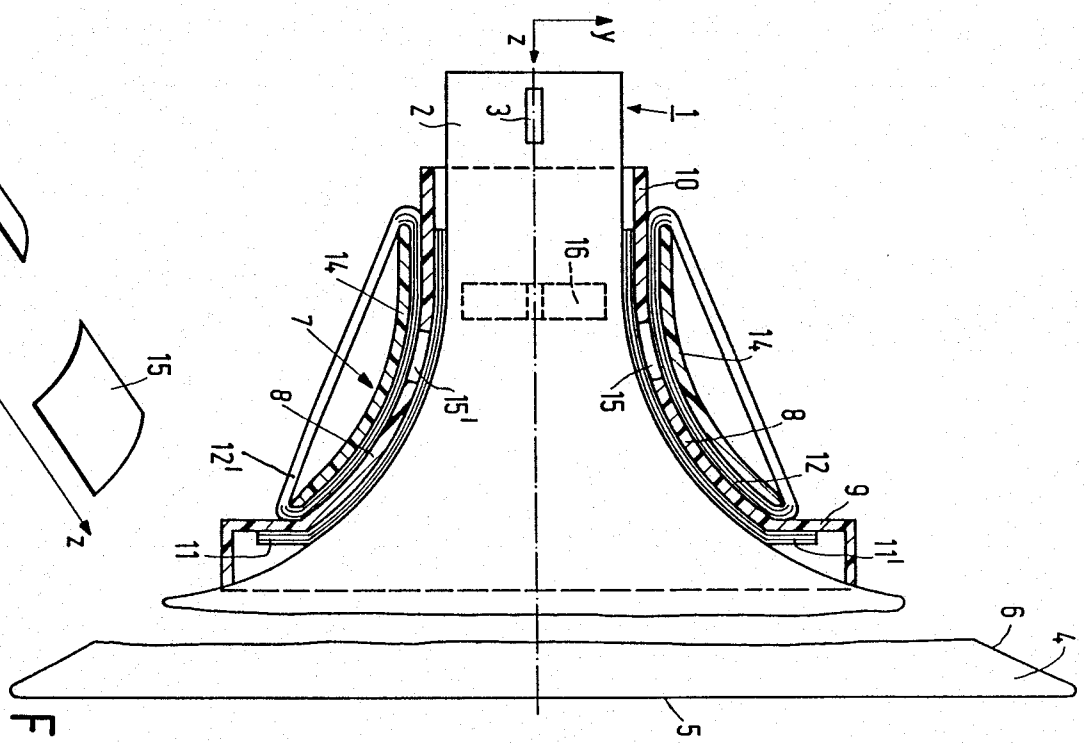
FIG. 1 diagrammatically shows a cross-section (taken on the y-z plane) of a display device comprising a colour picture tube and a deflection unit mounted thereon.

FIG. 1 shows in a cross-section a colour picture tube 1 with an envelope 6 extending from a narrow neck portion 2 in which an electron gun system 3 is mounted to a wide cup-shaped portion 4 which is provided with a display screen 5. A deflection unit 7 is mounted on the tube at the transition between the narrow and the wide portion. This deflection unit 7 has a support 8 of an insulating material with a front end 9 and a rear end 10. Between these ends 9 and 10 there are provided on the inside of the support 8 a system of deflection coils 11, 11' for generating a (horizontal) deflection field for the horizontal deflection of electron beams produced by the electron gun system 3. The system of deflection coils 11, 11' is surrounded by an annular core 14 of a magnetizable material on which a system of coils 12, 12' for generating a (vertical) deflection field for the vertical deflection of electron beams produced by the electron gun system 3 is wound toroidally. The coils 11, 11' of the line deflection coil system consist of a first side packet and a second side packet, and a rear end segment (facing the gun 3) and a front end segment (facing the display screen 5) together defining a window. Compared with the front end segment, the rear end segment is arranged contiguously to the tube wall in the Figure. The invention, however, also relates to line deflection coils having a flange shaped rear end segment. The system of field deflection coils 12, 12' is provided with conventional astigmatism correction elements 15, 15' of a soft magnetic material which are parallel and closer to the tube axis 2 than the field deflection coils 12, 12'. The elements 15, 15' are provided in such a way that they face the coils 12, 12' on the inside thereof. They are positioned in the proximity of the centre of the deflection field generated by the coils 12, 12' and smmmetrically with respect to the plane in which the non-deflected electron beams are located. This is the x-z plane in FIG. 1. This positioning corresponds to the positioning of the astigmatism correction elements described in U.S. Pat. Spec. No. 4,242,612, which is substantially parallel to the field deflection field. However, the present invention provides for a novel additional set of soft magnetic correction elements 16, 16' (of which only element 16 is shown in FIG. 1) which are rotated 90° with respect to the elements 15, 15', and therefore are orthogonal to and cut across said field deflection field. The elements 16, 16' (which possibly, as shown, may each consist of two parts) are closer to the entrance side of the deflection field generated by the field deflection coils 12, 12' (hence closer to the electron gun system 3) than the elements 15, 15', which are in a position where some pre-deflection of the electron beams has already taken place. Therefore, elements 16, 16' have a positive action on the astigmatism error.

Figure 2:
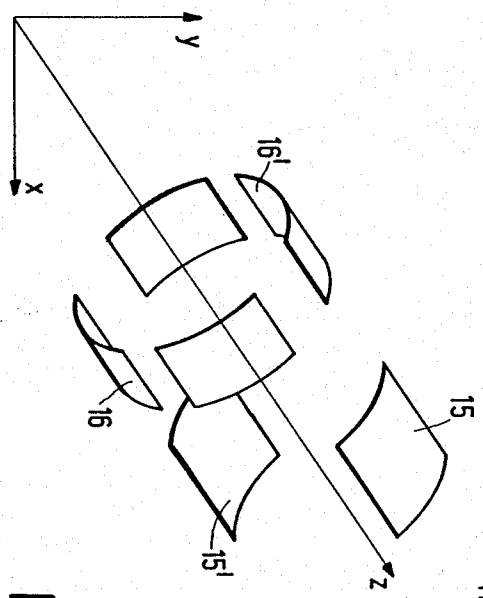
FIG. 2 is a perspective elevational view of the correction elements used in the deflection unit of FIG. 1.

As is clearly evident from FIG. 2 in which the same reference numerals as in FIG. 1 have been used for the same components, the elements 16, 16' are located symmetrically with respect to the plane through the tube axis which is at right angles to the plane of the non-deflected electron beams. This is the y-z plane in the Figure.

What is claimed is:

1. In a combination comprising: a colour picture tube whose neck accommodates an electron gun system for emitting to a display screen three co-planar electron beams, including a central beam which coincides at least substantially with the axis of the picture tube and two outer beams located on either side thereof; a deflection unit which is secured coaxially around the neck of the picture tube and which comprises a system of line deflection coils which, when energized, produces a line deflection magnetic field which deflects the electron beam in a line direction and a system of field deflection coils which, when energized, produces a field deflection magnetic field orthogonal to the line deflection magnetic field and which deflects the electron beam in a field direction at right angles to the line direction; and a first pair of astigmatism correction elements of a soft magnetic material respectively positioned symmetrically on opposite sides of the plane through the non-deflected electron beams and extending substantially parallel to said field deflection magnetic field, such elements being located between the systems of line and field deflection coils in the proximity of the centre of the field deflection magnetic field generated by the system of field deflection coils; the improvement comprising:

a second pair of astigmatism correction elements of a soft magnetic material respectively positioned symmetrically on opposite sides of the plane through the tube axis normal to the plane through the non-deflected electron beams, so that such second pair of correction elements are angularly rotated substantially 90° relative to the first pair of correction elements and each extend substantially orthogonal to and cut across said field deflection magnetic field;

said second pair of correction elements being located in a position at which field pre-deflection is produced by the deflection field generated by the system of field deflection coils and which is closer to the beam entrance side of such deflection field than the center thereof;

said second pair of correction elements providing astigmatism correction of higher order components of the deflection field.

2. A colour picture tube as claimed in claim 1, characterized in that the second pair of astigmatism correcting elements are at an axial position where field pre-deflection is produced but substantially no line pre-deflection is produced by said deflection unit.

* * * * *